United States Patent [19]

Bisbing

[11] Patent Number: 4,735,151

[45] Date of Patent: Apr. 5, 1988

[54] LATCH AND HINGE ASSEMBLY

[75] Inventor: Robert H. Bisbing, Springfield, Pa.

[73] Assignee: Southco, Inc., Concordville, Pa.

[21] Appl. No.: 41,474

[22] Filed: Apr. 23, 1987

Related U.S. Application Data

[63] Continuation of Ser. No. 918,589, Oct. 10, 1986, which is a continuation of Ser. No. 864,280, May 19, 1986, abandoned.

[51] Int. Cl.[4] ..... A47B 1/04

[52] U.S. Cl. ..... 108/69; 108/63; 108/65; 108/78

[58] Field of Search ..... 108/69, 65, 67, 66, 108/73, 71, 76, 77, 78, 62; 292/130, 132, 247, 292; 16/115, 126

[56] References Cited

U.S. PATENT DOCUMENTS

| | | | |
|---|---|---|---|
| 2,907,616 | 10/1959 | Sullivan | 108/66 |
| 3,648,628 | 3/1972 | Davis | 108/65 X |
| 4,109,589 | 8/1978 | Ruckriegal et al. | 108/69 |
| 4,301,744 | 11/1981 | Walter | 108/78 X |

FOREIGN PATENT DOCUMENTS

| | | | |
|---|---|---|---|
| 25071 | of 1913 | United Kingdom | 108/69 |

*Primary Examiner*—James T. McCall
*Attorney, Agent, or Firm*—Paul & Paul

[57] ABSTRACT

A hinge and latch assembly for use in mounting an extension leaf to a support comprises at least one telescopic hinge mechanism mounted to the underside surface of the support at one end and mounted to the underside surface of the extension leaf at the other end and having a plurality of telescopic sliding members disposed between the two ends, and a pivot connection between the members and the one end connected to the extension leaf whereby the leaf can be pivoted 180° when the mechanism is fully extended between a use position and a storage position; and at least one latch mechanism mounted to the underside surface of the extension leaf for retaining the extension leaf in the use position wherein the latch mechanism is automatically unlatched when the extension leaf is in the storage position and is automatically latched when the extension leaf is moved out of the storage position.

8 Claims, 6 Drawing Sheets

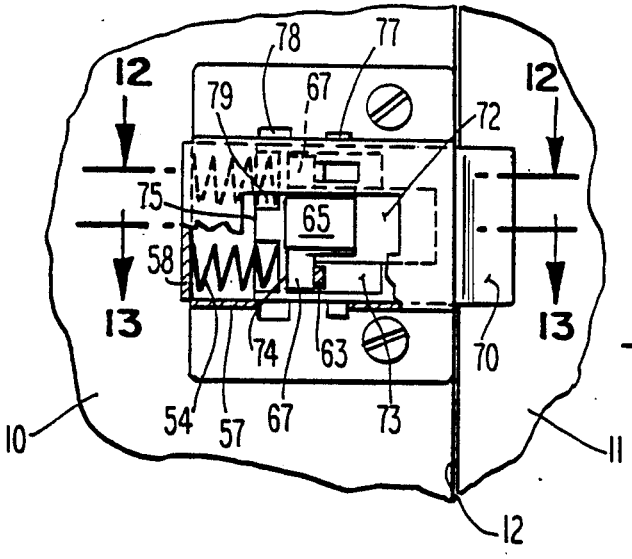
Fig. 11
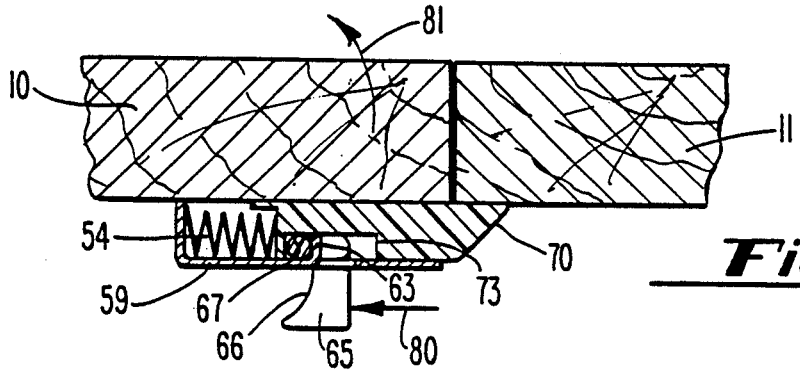
Fig. 12
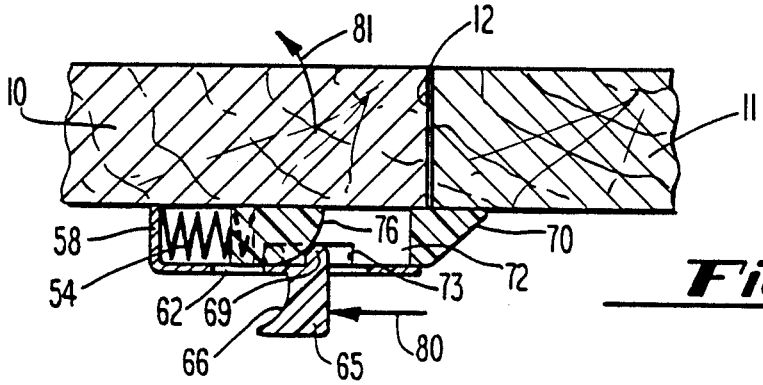
Fig. 13
Fig. 14
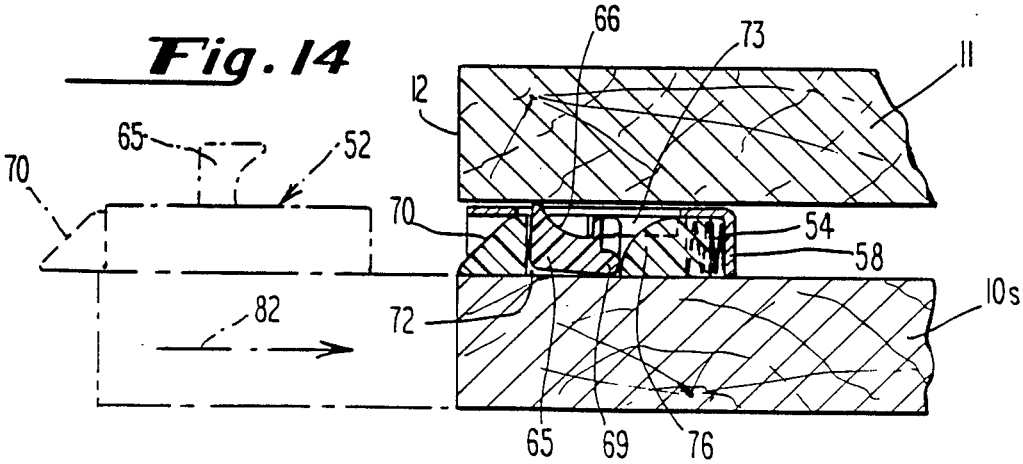

LATCH AND HINGE ASSEMBLY

CROSS-REFERENCE TO RELATED APPLICATIONS

This application is a continuation of U.S. patent application Ser. No. 918,589, filed Oct. 10, 1986, which is a File Wrapper Continuation of U.S. patent application Ser. No. 864,280, filed May 19, 1986, now abandoned.

BACKGROUND OF THE INVENTION

This invention relates to a hinge and latch assembly for mounting an extension leaf to a support. More specifically, the invention relates to such an assembly using a telescopic hinge mechanism and a latch mechanism adapted to be automatically actuated in response to the movement of the extension leaf between storage and use positions.

It is a well known practice to use extension leaves to enlarge or otherwise alter the size and shape of a table surface. It is typical to attach the extension leaf to the edge of the table with a hinge, in which case the extension leaf hangs vertically underneath the table when not in use, which is undersirable because it interferes with the seating comfort in the area of the leaf and thus reduces the overall utility of the table.

These assemblies have the further disadvantage in that the leaf swings in an arc which is centered at the edge of the table and thereby encroaches on a considerable amount of space beneath the table. As such, these assemblies are not practical for use with a countertop or the like where the space below is used for storage.

Other types of assemblies for mounting extension leaves are known which allow the leaf to be stored in a horizontal position beneath the table surface. These assemblies, however, do not overcome the above-mentioned disadvantage in that they also rotate the leaf at the edge of the table or other support. Moreover, these assemblies were often difficult to assemble and were often incapable of retrofit application. Furthermore, these assemblies often required an additional member to support the extension leaf in the use position, typically a separate swingout table leg or other support structure. The need for a separate support structure was a further obstacle to retrofit application of the assembly.

Still other types of hinge-latch mechanisms are known, such as that disclosed in U.S. patent application Ser. No. 636,819, filed Aug. 1, 1984. These mechanisms typically include a manually actuated latch to retain the extension leaf in the use position.

I have invented an improvement over the above-mentioned assemblies for mounting an extension leaf to a support which allows the leaf to be stored in a space-saving position underneath and parallel to the support surface and which pivots about the center of the leaf in such a way so as to not to encroach upon the space beneath the support. The invention also elminates the need for a separate structure to support the leaf and further provides for the leaf to be automatically secured in the storage or use positions. The invention is extremely simple in assembly and installation and further can be manufactured by high-production, non-labor intensive processes which reduces the overall cost of the assembly.

SUMMARY OF THE INVENTION

Accordingly, it is an object of the invention to provide a novel hinge and latch assembly for mounting an extension leaf to a support, such as a table or countertop.

It is another object of the invention to provide a hinge and latch assembly which is easy to install and has extensive retrofit application potential.

It is another object of the invention to provide a hinge and latch assembly having at least one telescopic hinge mechanism and at least one automatic latch mechanism.

It is another object of the invention to provide a hinge and latch assembly that allows for the extension leaf to be pivoted 180° from a storage position to a use position.

It is a further object of the invention to provide a hinge and latch assembly wherein the extension leaf is automatically secured in the use or storage positions.

It is another object of the invention to provide a hinge and latch assembly wherein the movement of the extension leaf from storage to use positions does not encroach upon useful space beneath the support surface.

It is another object of the invention to provide a hinge and latch assembly wherein the hinge mechanism does not project beyond the edges of a nominally sized extension leaf when in the storage position.

It is another object of the invention to provide a hinge and latch assembly wherein the hinge mechanism is a telescopic hinge comprising a base member adapted for being affixed to the underside surface of a support, a slide member connected to said base member for sliding telescopic movement therewith, a leaf member connected to said slide member for sliding movement therealong, and a bracket member adapted for being affixed to an underside surface of an extension leaf and pivotally connected to said leaf member.

It is another object of the invention to provide detent means for limiting the movement of said hinge members and for retaining said hinge members in a retracted or extended condition.

It is still another object of the invention to provide a hinge and latch assembly wherein the latch mechanism comprises a latch housing adapted for being affixed to an underside surface of an extension leaf, a latch bolt slidably disposed in said housing, means for urging the latch bolt into a latched condition, an actuating lever positioned within the housing and extending therefrom and being slidingly movable in a first direction and pivotally movable in a second, opposite direction; and means for retracting said latch bolt in response to the movement of said actuating lever in the first or second directions.

These and other objects of the invention will become apparent upon a reading of the following brief description of the drawings, the detailed description of the invention, and the appended claims.

BRIEF DESCRIPTION OF THE DRAWINGS

FIG. 11 is a plan view of the mounted latch mechanism, partially broken away to illustrate the internal mechanics thereof.

FIG. 12 is a sectional view of the mounted latch mechanism with the extension leaf in a position of use illustrating the sliding movement of the actuating lever in the first direction and the rigid operating means to retract the latch bolt and taken along line 12—12 of FIG. 11.

FIG. 13 is a sectional view of the mounted latch mechanism taken along line 13—13 of FIG. 11, showing the cam and lever operating means to retract the latch bolt.

FIG. 14 is a sectional view of the mounted latch mechanism illustrating the movement of the extension leaf into a position of storage and illustrating the automatic pivoting movement of the actuating lever in the second direction to retract the latch bolt when the extension leaf is in the storage position.

DETAILED DESCRIPTION OF THE EMBODIMENTS

Figure 2:
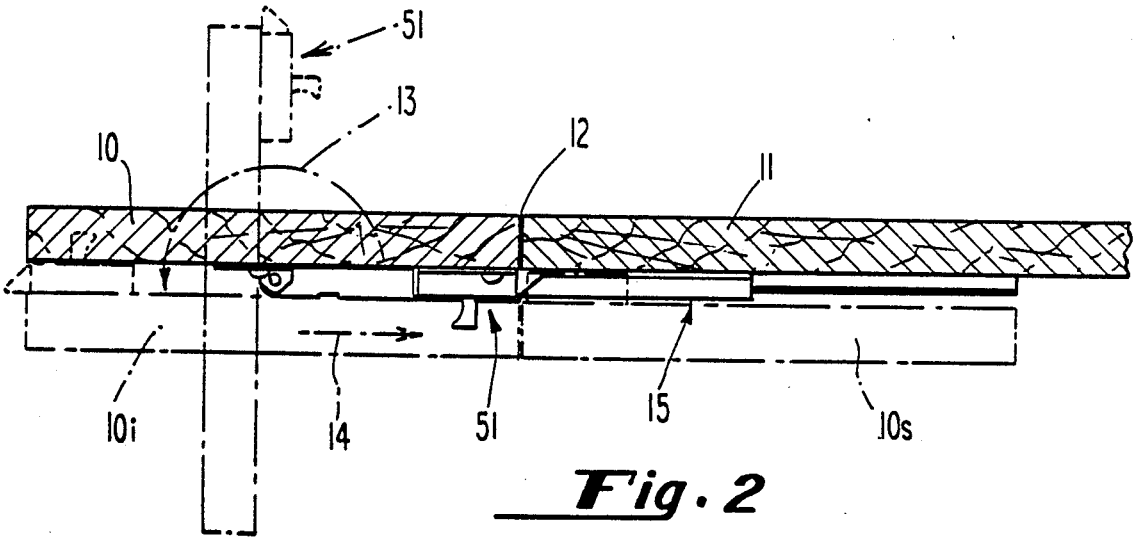
FIG. 2 is a side elevational view of the invention mounted to the underside surfaces of the support and extension leaf and taken along line 2—2 of FIG. 1, with the movement of the extension leaf from a position of use to a position of storage being illustrated therein.
Figure 1:
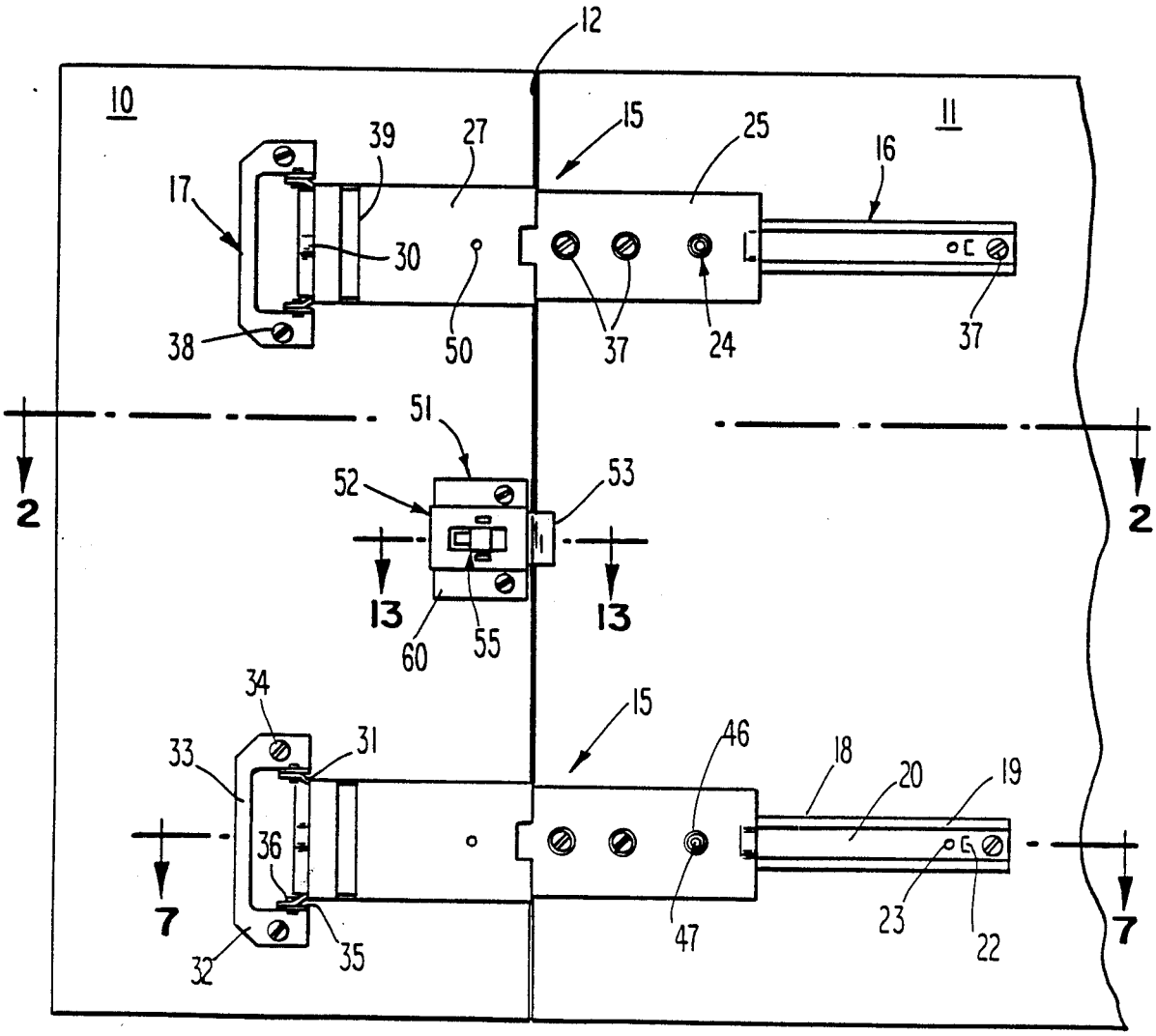
FIG. 1 is a view of the underside surface of a support and extension leaf when the leaf is in an extended position for use, showing one embodiment of the hinge and latch assembly of the present invention mounted thereto.
Figure 1A:
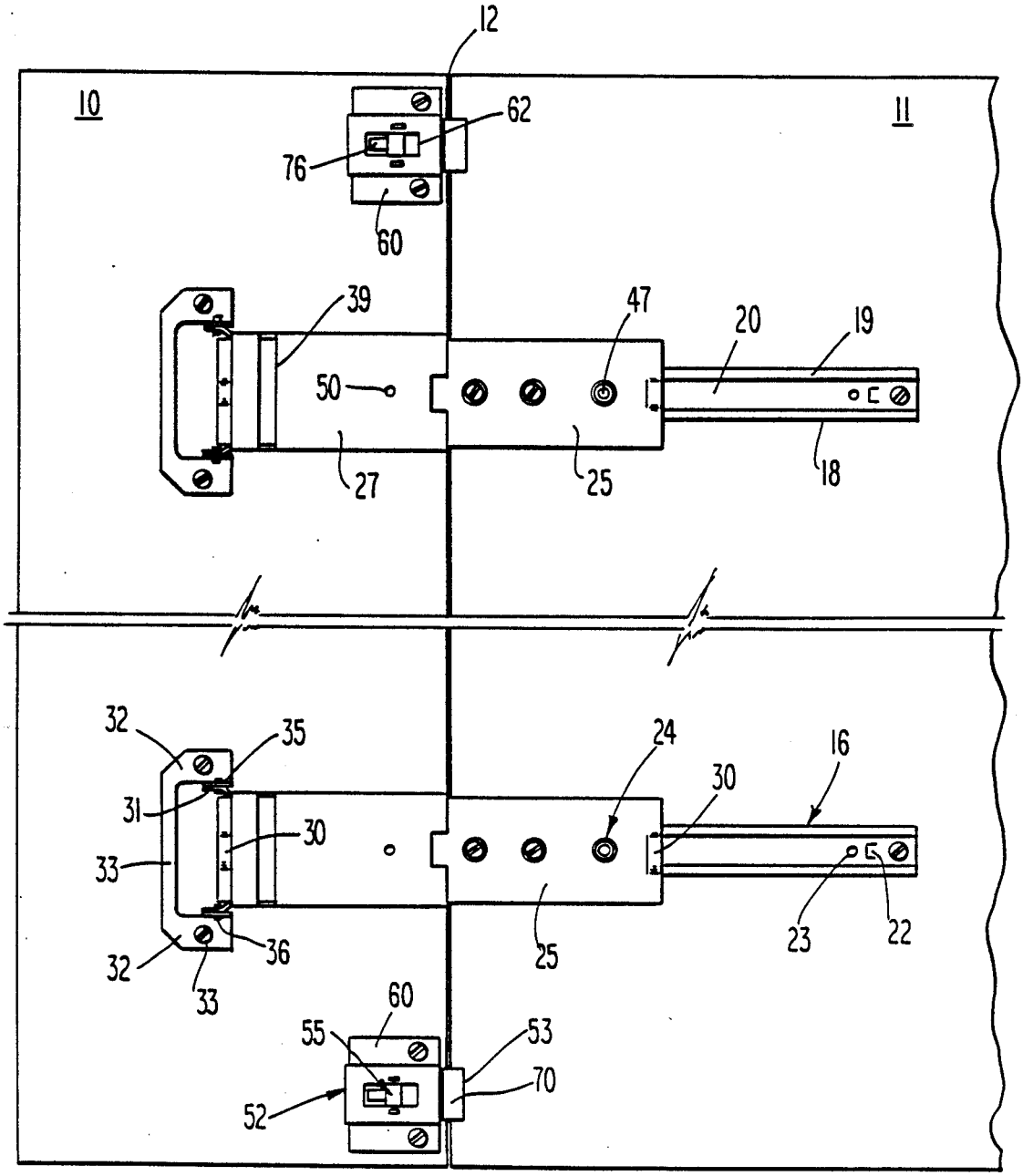
FIG. 1A is a view of the underside surface of a support and extension leaf when the leaf is in an extended position for use, showing a preferred embodiment of the hinge and latch assembly mounted thereto.

FIGS. 1, 1A and 2 illustrate preferred embodiments of the hinge and latch assembly of the invention, as applied, to mount an extension leaf to a support, such as a table, countertop, or other horizontal support member. In the view shown in the Figures, the extension leaf 10 is positioned substantially coplanar with table 11 and abuts table edge 12, whereby extension leaf 10 and table 11 form a substantially continuous planar table surface. This position is referred to hereinafter as the "second" or "use" position.

Figure 6:
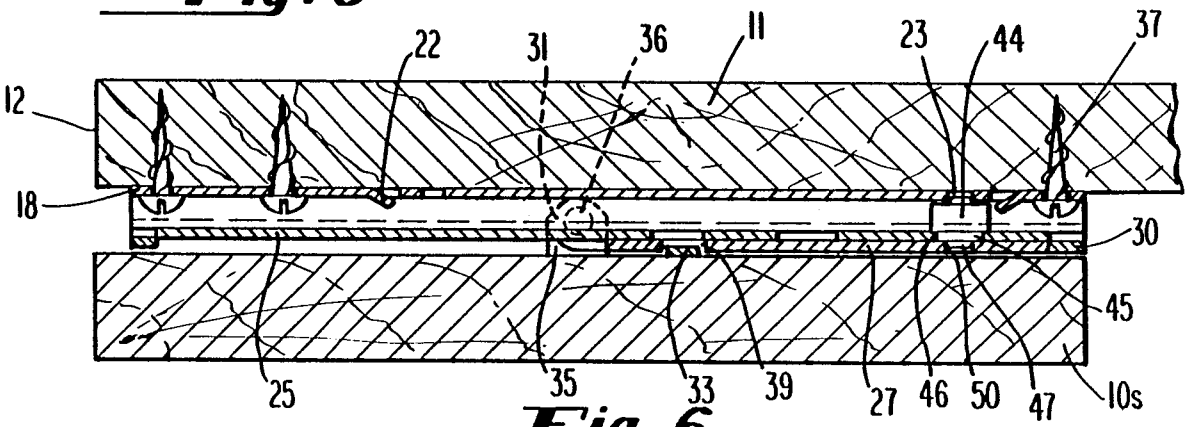
FIG. 6 is a sectional view of the mounted hinge mechanism in the fully retracted condition wherein the extension leaf is in a position of storage.

The "first" or "storage" position of extension leaf 10 is illustrated in FIG. 6 and in broken lines in FIG. 2, and is designated as 10*s*. As seen in these Figures, extension leaf 10 is stored in a position substantially parallel to and adjacent the underside surface of table 11, and is retained completely in underlying disposition to table 11 and lies flush with table edge 12.

Figure 5:
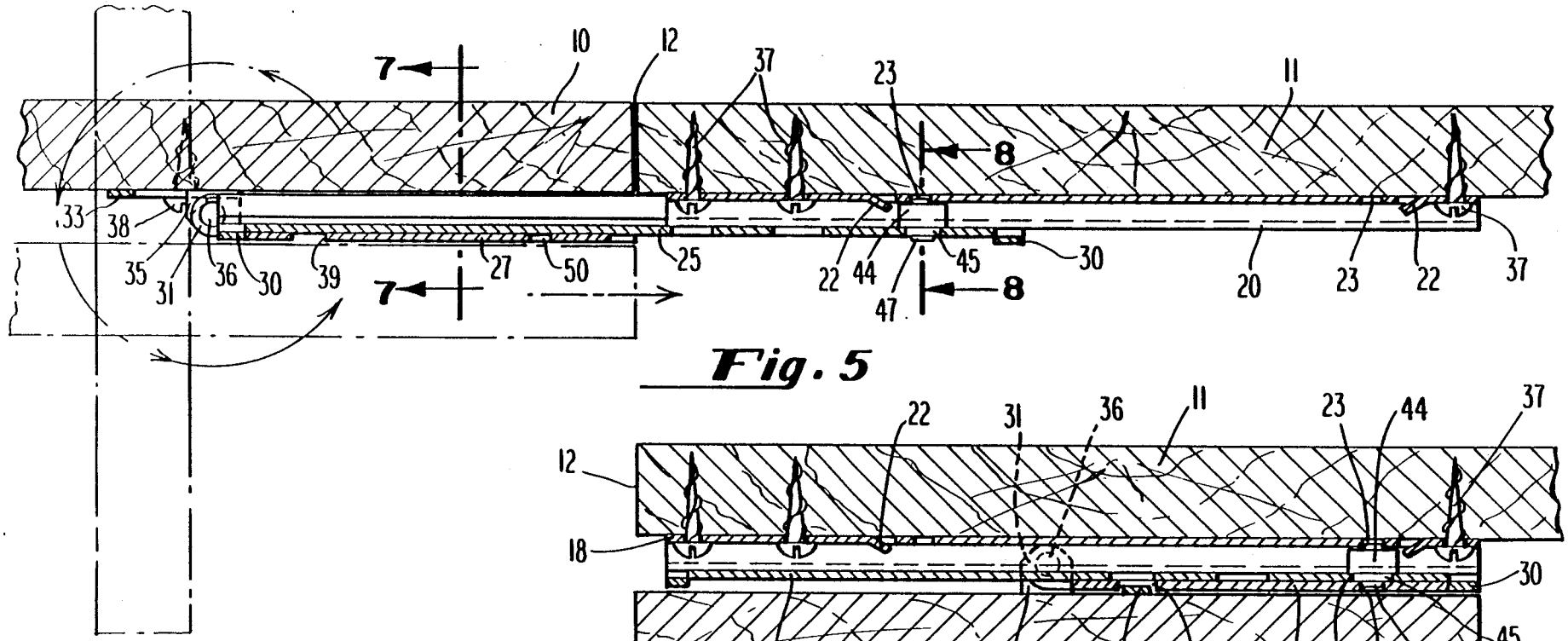
FIG. 5 is a sectional view of the mounted hinge mechanism in the extended condition taken along line 5—5 of FIG. 1, and illustrating the movement of the extension leaf from a position of use to a position of storage.

The movement of extension leaf 10 from the second position to the first position is illustrated in broken lines and arrows in FIGS. 2 and 5. Extension leaf 10 is released from the second position by actuating the latch mechanism of the invention, yet to be described, and is then rotated substantially 180° in the direction of arrow 13 to an intermediate position designated 10*i* in the Figures. From the intermediate position 10*i*, extension leaf 10 is slide in the direction of arrow 14 to the storage position 10*s*.

The hinge mechanism of the invention, as described more fully below, is designed to allow the sliding and rotating of the extension leaf 10 relative to table 11 and further serves to retain the extension leaf 10 in the storage position. The latch mechanism of the invention, also described below, is designed to retain the extension leaf 10 in the use position and is automatically unlatched when the extension leaf is slid into the storage position.

With reference to FIG. 1A, the preferred embodiment of the hinge and latch assembly of the present invention comprises a pair of telescopic hinge mechanisms 15 disposed in parallel spaced-apart relation to one another and connected to the underside surface of table 11 at one end and connected to the underside surface of extension leaf 10 at the other end. The hinge mechanism is provided with a plurality of members disposed in sliding telescopic relation to one another and pivot means at the end connected to the extension leaf 10. As seen in FIG. 1A, the hinge mechanisms 15 are in a fully extended condition when the extension leaf is in the use position.

The preferred embodiment of the assembly further comprises a pair of latch mechanisms 51 mounted to the underside surface of the extension leaf 10. The latch mechanisms 51 are positioned to traverse table edge 12 and engage the underside surface of table 11 when the latch mechanisms are in a latch condition, as illustrated, which retains the extension leaf 10 in the use position, as shown.

FIG. 1 illustrates a similar embodiment with only one latch mechanism being used, in which case it is preferrably to have the hinge mechanisms spaced further apart and the latch mechanism generally centered on the extension leaf.

Figures 3, 4:
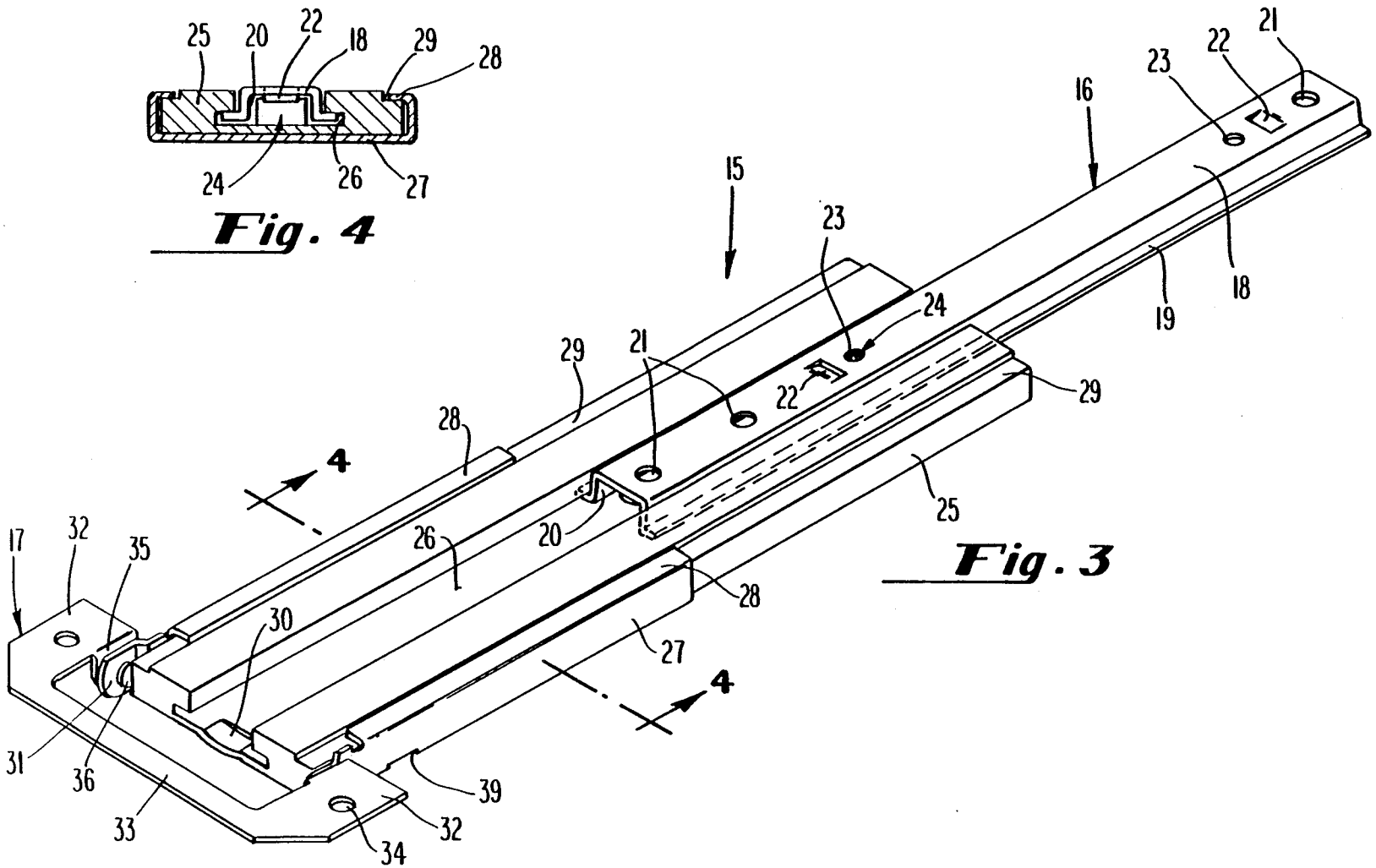
FIG. 3 is a perspective view of a preferred embodiment of the hinge mechanism of the invention in fully extended condition as seen from the upper surface to be engaged with the underside surface of the support and extension leaf.
FIG. 4 is a sectional view of the hinge mechanism taken along line 4—4 of FIG. 3.

The telescopic hinge mechanism of the present invention will now be described with reference to FIGS. 3-8. With particular reference to FIGS. 3 and 4, the hinge mechanism 15 comprises a base member 16 adapted to be affixed to the underside surface of table 11 and a bracket member 17 adapted to be affixed to the underside surface of extension leaf 10. A plurality of members in sliding telescopic arrangement are disposed intermediate the base member 16 and the bracket member 17, whereby the hinge mechanism 15 can be slid between the retracted condition (see FIG. 6) and the extended condition as illustrated in FIG. 3.

The base member 16 is preferably a guide rail 18 of generally U-shaped cross section (see FIG. 4) having outwardly turned lower edges to form longitudinal flanges 19. A channel 20 extends longitudinally through guide rail 18 and is provided with a plurality of holes 21 along the midline thereof to facilitate the mounting of guide rail 18 to the underside surface of table 11. (See FIGS. 5 and 6) A stop member 22 is provided near each end of guide rail 18 that extends downwardly into channel 20. (See FIGS. 5 and 6) A pair of detent apertures 23 are also provided along the midline of channel 20, near the stop members 22. The stop members 22 and detent apertures 23 cooperate with detent means 24, yet to be described, to limit the telescopic sliding movement of the hinge mechanism and to lock the members in an extended or retracted condition.

Figure 7:
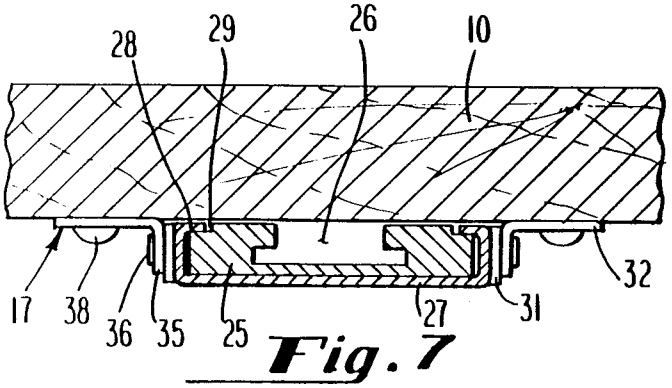
FIG. 7 is a sectional view of the mounted hinge mechanism in the extended condition illustrating the engagement of the slide member, the leaf member and the bracket member and taken along line 7—7 of FIG. 5.

A slide member 25 is provided with a channel 26 therein, of substantially T-shaped cross section, which is designed to receive guide rail 18 whereby slide member 25 is carried in sliding telescopic engagement with guide rail 18. As seen in FIGS. 5 and 7, slide member 25, when extended, traverses table edge 12 and provides support for the extension leaf in the use position, thus eliminating the need for a separate support structure.

A leaf member 27 of substantially flattened U-shape in cross section has inwardly turned upper edges which form flanges 28 that overlap slide member 25. Flanges 28 are received in longitudinal recesses 29 on the upper surface of the slide member. Leaf member 27 is prevented from sliding past the ends of slide member 25 by a pair of downwardly projecting lips 30 disposed on the lower surface of slide member 25. In other words, leaf member 27 slides along the length of slide member 25 but does not extend beyond the edges of slide member 25. (See FIGS. 5 and 6) Outwardly extending mounting arms 31 are provided as an extension of the vertical sides of the leaf member to facilitate the connection of bracket member 17 to leaf member 27.

As seen in the FIG. 3, bracket member 17 is a flat, substantially C-shaped piece having a pair of flared ends 32 and a narrow cross member 33. The flared ends 32 are provided with holes 34 to facilitate the mounting of bracket member 17 to the extension leaf 10. A downwardly turned tab 35 is provided on each of the flared ends 32 which mates with mounting arms 31 of leaf member 27. A pivot pin 36 extends through tab 35 and mounting arm 31 and forms the pivoting connection between the bracket member 17 and the leaf member 27.

FIGS. 5 and 6 illustrate the hinge mechanism of the invention as applied to mount the extension leaf 10 to the table 11 and shown in the fully extended and fully retracted conditions, respectively. Guide rail 18 is mounted to the underside surface of table 11 by a plurality of wood screws 37 and similar wood screws 38 mount the bracket member 17 to the underside surface of extension leaf 10. When the hinge mechanism is in the extended condition of FIG. 5, extension leaf 10 is free to rotate 180° into the intermediate position **10*i* and is then slid underneath table 11 into the storage position 10*s* of FIG. 6. In the storage position, as illustrated in FIG. 6, extension leaf 10 is disposed substantially parallel to table 11 due to cross member 33 of bracket member 17 being received within transverse slot 39 in the lower surface of leaf member 27. As also seen in FIG. 6, pivot pins 36 are positioned underneath table 11 whereby extension leaf 10 is prevented from rotational movement. Accordingly, no additional means is required to retain the extension leaf 10 in the storage position 10*s***.

As can be seen from the Figures, extension leaf 10 is stored only slightly below table 11 and parallel thereto, whereby extension leaf 10 occupies only a small amount of space beneath the table. Furthermore, the rotational movement of extension leaf 10 occurs at a distance from table edge 12 and thereby does not encroach upon the space beneath table 11. As such, the invention is advantageous for use in mounting an extension leaf to a countertop or the like where storage space beneath the countertop is often a premium.

Moreover, with reference to FIG. 6, the hinge mechanism 15 is rather compact in length when in the retracted condition and does not extend beyond the edge of a nominally sized extension leaf. This feature is particularly advantageous when it is desired to have an extension leaf mounted to each edge of a rectangular table or to a countertop having a relatively short overhang, and increases the overall utility of the invention.

FIGS. 5 and 6 further illustrate the movement of detent means 24 and the function of stop member 22 and detent apertures 23. As seen from the Figures, the detent means 24 is carried by slide member 25 in channel 26 thereof and is received in channel 20 of guide rail 18. (See FIG. 4) Detent means 24 thus slides with slide member 25 relative to guide rail 18. The stop members 22 are positioned to correspond to the fully extended and fully retracted conditions of slide member 25 and prevent the detent means 24 and thus slide member 25 from sliding past these reference positions. The detent means 24, when in a reference position, cooperates with detent apertures 23 to lock the slide member 25 in position.

Figure 8:
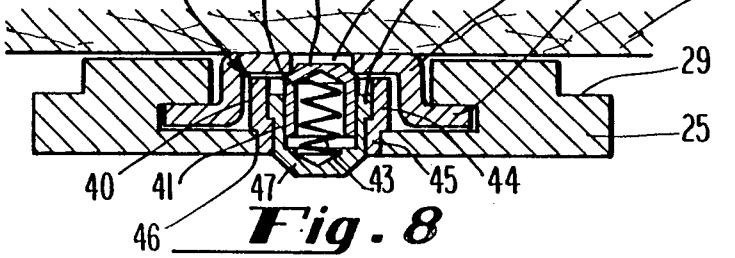
FIG. 8 is a sectional view of the detent means of the hinge mechanism taken along line 8—8 of FIG. 5.

With reference to FIG. 8, the detent means 24 comprises a sleeve member 40, a shell member 41, a button 42 and a spring 43. The sleeve member 40 is a hollow, substantially cylindrical member having a first ring portion 44 and a second ring portion 45. The second ring portion 45 is tightly received in an opening 46 in the lower surface of slide member 25 whereby detent means 24 is slidingly carried by slide member 25. First ring portion 44 is disposed in channel 26 of slide member 25, as shown. Shell member 41 is slidably disposed in sleeve member 40 and extends downwardly through second ring portion 45. Shell member 41 has a beveled face 47 which projects beyond the lower surface of slide member 25. An annular flange 48 is provided on shell member 41 at the upper end thereof and corresponds in diameter to the first ring portion 44 of sleeve member 40 which prevents shell member 41 from sliding out of sleeve member 40. Button 42 is slidably disposed within shell member 41 and projects in the opposite direction. Button 42 also has a beveled face 49 which is designed to be received in detent apertures 23 of guide rail 18. Spring 43 is positioned between shell member 41 and button 42 and urges beveled faces 47 and 49 apart. As seen in FIG. 6, beveled face 47 of shell member 41 is received within a hole 50 in the lower surface of leaf member 27 when the hinge mechanism is in the fully retracted condition and beveled face 49 of button 42 is received within detent aperture 23 of guide rail 18. As such, the detent means 24 serves to lock the hinge mechanism 15 in the fully retracted condition.

From the foregoing, the multiple functions of the detent means 24 can be summarized as follows: detent means 24 locks the hinge mechanism 15 in the fully retracted condition (FIG. 6); it locks the slide member 25 in the fully extended condition (FIG. 5); and it controls the sliding telescopic movement of slide member 25 relative to guide rail 18 (FIGS. 5,6).

Figure 9:
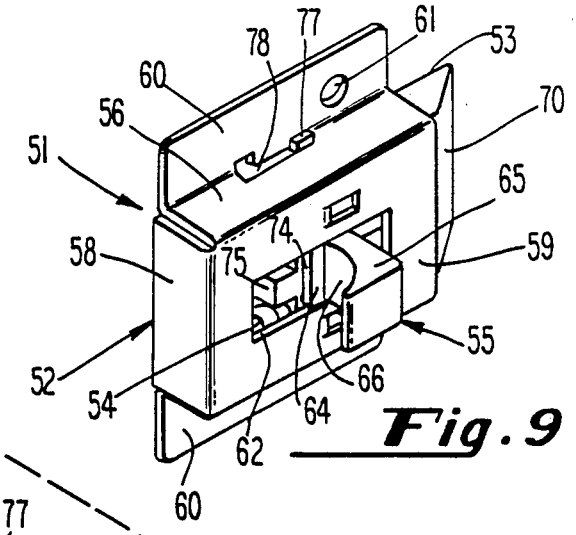
FIG. 9 is a perspective view of a preferred embodiment of the latch mechanism of the invention in the latched condition.
Figure 10:
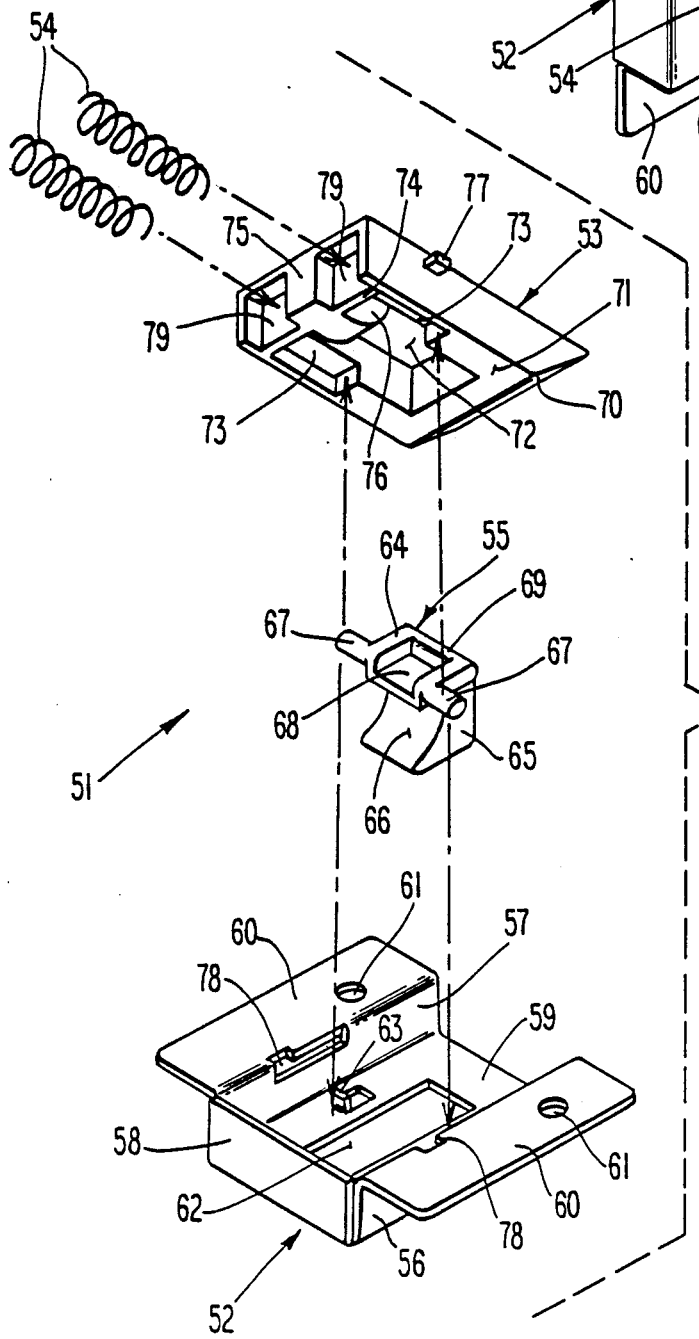
FIG. 10 is an exploded perspective view of the latch mechanism as seen from the opposite surface of that shown in FIG. 9.

The second component of the hinge and latch assembly in accordance with the invention is the latch mechanism 51 which will now be described in detail with reference to FIGS. 9–14. As seen in FIGS. 9 and 10, the latch mechanism 51 comprises a latch housing 52, a latch bolt 53, springs 54, and an actuating lever 55. The latch housing 52 is a box-shaped piece and has side walls 56,57, a back wall 58, and a bottom wall 59. The top and front of housing 52 are open. The upper edges of side walls 56,57 are bent outwardly to form mounting flanges 60,60. Mounting flanges 60 are provided with holes 61 to facilitate the mounting of housing 58 to the underside surface of extension leaf 10. Generally centrally located in bottom wall 59 is a rectangular opening 62 through which a portion of actuating lever 55 is disposed when the latch mechanism 51 is assembled. Upwardly projecting stop members 63 are provided on bottom wall 59 on the longitudinal sides of rectangular opening 62, the function of which will be described hereinbelow.

The actuating lever 55 comprises a generally square base portion 64 and a knob portion 65 extending therefrom. The knob portion 65 projects through rectangular opening 62 in bottom wall 59 and base portion 64 is retained by bottom wall 59 when the latch mechanism 51 is assembled, as shown in FIG. 9. Knob portion 65 is preferably provided with a concave back surface 66, the importance of which is described hereinafter. A pair of transverse pins 67 extend outwardly from base portion 64 of actuating lever 55 and are positioned adjacent to the back surface of stop members 63 when actuating lever 55 is placed within housing 53. Actuating lever 55 is thus free to slide in rectangular opening 62 toward back wall 58 of housing 52 but is prevented from sliding forward in the opening due to the contact between the transverse pins 67 and stop members 63. Rather, when moved in the forward direction, actuating lever 55 pivots about transverse pins 67 into the rectangular opening 62 and housing 52. (See FIG. 14) As more fully described hereinafter, the sliding or pivoting of actuating lever 55 causes latch bolt 53 to retract into housing 52. The base portion 64 is provided with a cavity 68 which opens towards the back of base portion 64 and forms a lug 69 on the front of base portion 64.

The latch bolt 53 is a substantially box-shaped piece having a beveled front wall 70 which slopes upwardly and outwardly from the bottom surface 71 of the latch bolt 53. The beveled front wall 70 extends beyond latch housing 52 when the latch mechanism is in the latched condition, as shown in FIG. 9. A rectangular opening 72 is provided in the general center of latch bolt 53 which is sized to receive base portion 64 of actuating lever 54, and is also sized to accomodate knob portion 65 when actuating lever 55 is pivoted forward. (See FIG. 14) A pair of longitudinal shoulder notches 73 are provided in bottom surface 71 of latch bolt 53, one on each side of opening 72, which receive transverse pins 67 therein when the latch mechanism is assembled.

A transverse wall 74 separates rectangular opening 72 from back wall 75 of latch bolt 53. As more fully described hereinafter, transverse wall 74 and transverse pins 67 comprise rigid operating means for retracting latch bolt 53 in response to the sliding movement of actuating lever 55. A convex cam member 76 projects into opening 72 from transverse wall 74 and is received within cavity 68 of base portion 64 of the actuating lever when the mechanism is assembled. (See FIG. 13) As yet to be described, cam member 76 cooperates with lug 69 of actuating lever 55 to comprise means for retracting latch bolt 53 in response to the pivoting movement of actuating lever 55. The proper alignment of latch bolt 53 in housing 52 is assured by providing an outwardly extending lug 77 on each side of the latch bolt which are received within slots 78 on the side walls 56,57 of housing 52.

A pair of coil springs 54 are disposed between back wall 58 of housing 52 and latch bolt 53 to urge the latch bolt into the extended condition illustrated in FIG. 9. Springs 54 are preferably disposed in cavities 79 in back wall 75 of latch bolt 53 to prevent undersirable lateral movement of springs 54.

With reference to FIGS. 11–14, the cooperation of the various elements comprising the latch mechanism 51 will now be described, including the means for retracting the latch bolt 53 in response to movement of the actuating lever 55. As can be seen from the Figures, the latch mechanism 51, when assembled, is normally in a latched condition due to springs 54 urging latch bolt 53 forward and out of the open front of latch housing 52. As seen in FIGS. 10–12 when the mechanism is in the latched condition, lugs 77 are disposed against the forwardmost end of slots 78, and transverse wall 74 is urged against transverse pins 67, which in turn are urged against stop members 63. As also seen from the Figures, latch mechanism 51 is positioned so that latch bolt 53, when in the latched condition, traverses table edge 12 and engages the underside surface of table 11 when extension leaf 10 is in the use position, and thereby retains extension leaf 10 in the use position.

When it is desired to store the extension leaf, the actuating lever 55 is slid towards back wall 58 of housing 52, in the direction indicated by arrow 80 in FIGS. 12 and 13. The sliding movement of actuating lever 55 causes transverse pins 67 to contact transverse wall 74 and thereby force latch bolt 53 toward back wall 58 and into an unlatched condition. When latch bolt 53 has been retracted into housing 52, extension leaf 10 is free to rotate in the direction of arrow 81 into the intermediate position. From the intermediate position, extension leaf 10 is slid underneath table 11 whereupon table edge 12 contacts the concave surface 66 of knob portion 65 of actuating lever 55. The further sliding of extension leaf 10 in the direction of arrow 82 of FIG. 14 causes actuating lever 55 to pivot forward, whereby lug 69 contacts convex cam member 76 to retract latch bolt 53 into housing 52. As seen in FIG. 14, actuating lever 55 is pivoted forward and is received in opening 72 of latch bolt 53 when extension leaf 10 is in the storage position 10s, and is retained in this condition by the underside surface of table 11.

The concave surface 66 of knob portion 65 corresponds to the arcuate motion of actuating lever 55 as it is pivoted and allows for the smooth pivoting of the actuating lever as the extension leaf is slid underneath the table, and further allows for substantially complete retraction of latch bolt 53 into housing 52.

When it is then desired to return the extension leaf to the use position, extension leaf 10 is slid out from underneath table 11 to the intermediate position and is then rotated into the use position. It is to be understood that as extension leaf 10 is slid out from underneath table 11, actuating lever 55 crosses table edge 12 and is thus free to return to the upright position whereupon latch bolt 53 is automatically returned to the latched condition by springs 54. Upon rotation of extension leaf 10 to the use position, beveled front wall 70 contacts table edge 12 and latch bolt 53 is temporarily retracted against the force of springs 54 until extension leaf 10 is fully rotated, whereupon springs 54 again urge latch bolt 53 into the latched condition and extension leaf 10 is secured in the use position.

As can be seen from the Figures, particularly FIG. 14, the latch housing 52 is sized so as to fit snugly between the extension leaf 10 and the underside surface of table 11 when the leaf is in the storage position. As such, latch housing 52 functions as an effective stop member to prevent any pivotal movement of extension leaf 10 when in the storage position. The knob portion 65 of actuating lever 55 is also urged against the underside surface of table 11 by spring 54 and thus provides a close friction fit between the extension leaf 10 and the table 11.

From the foregoing description, it can be seen that the hinge and latch assembly of the present invention is capable of extensive retrofit application and, at most, requires only minor modifications of a table for installation. Furthermore, the entire assembly is preferably constructed of extruded or stamped metal and molded plastic components, thus greatly reducing manufacturing time and costs.

Preferred forms of the hinge and latch assembly of the invention have been described for purposes of illustration only and not for the purposes of limitation and various modifications or alternatives may suggest themselves to those skilled in the art, all of which are within the scope of the invention as defined in the appended claims.

What is claimed is:

1. A latch mechanism comprising:

(a) a latch housing;

(b) a latch bolt disposed within said housing for sliding movement therein between an extended latched condition and a retracted unlatched condition relative to said housing;

(c) means within said housing for urging said latch bolt into said extended latched condition;

(d) an actuating lever positioned within said housing in contact with said latch bolt and partially extending from said housing, said actuating lever being slidably movable in a first direction and pivotally movable in a second direction generally opposite to said first direction;

(e) means for retracting said latch bolt into said unlatched condition in response to the sliding movement of said actuating lever in said first direction; and (f) means for retracting said latch bolt into said unlatched condition in response to the pivoting movement of said actuating lever in said second direction.

2. The assembly of claim 1, wherein said means for urging said latch bolt into said extended latched condition comprises spring means.

3. The assembly of claim 2, wherein said spring means comprises at least one coil spring.

4. The assembly of claim 1, wherein said means for retracting said latch bolt in response to the sliding movement of said actuating lever in said first direction comprises rigid operating means.

5. The assembly of claim 4, wherein said rigid operating means comprises a pair of oppositely extending transverse pins connected to said actuating lever and contacting said latch bolt, wherein upon sliding movement of said actuating lever in said first direction, said transverse pins slide said latch bolt into said retracted unlatched condition.

6. The assembly of claim 1, wherein said means for retracting said latch bolt in response to the pivoting movement of said actuating lever in said second direction comprises cam and lever operating means.

7. The assembly of claim 6, wherein said cam and lever operating means comprises an forwardly projecting cam member connected to said latch bolt and a lug projection on said actuating lever contacting said cam member to slide said latch bolt into said unlatched condition when said actuating lever is pivoted in said second direction.

8. The assembly of claim 1, wherein said actuating lever is received within an opening in said latch bolt and within said housing when said actuating lever is pivoted in said second direction.

* * * * *